US011659883B2

(12) United States Patent
Welch, Sr. et al.

(10) Patent No.: US 11,659,883 B2
(45) Date of Patent: May 30, 2023

(54) FACEMASK FOR A HELMET AND FACEGUARD

(71) Applicant: Lear Corporation, Southfield, MI (US)

(72) Inventors: Thomas A. Welch, Sr., Ortonville, MI (US); Benedict J. Messina, Warren, MI (US); Mark Allyn Folkert, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 189 days.

(21) Appl. No.: 17/382,523

(22) Filed: Jul. 22, 2021

(65) Prior Publication Data

US 2022/0095734 A1 Mar. 31, 2022

Related U.S. Application Data

(60) Provisional application No. 63/085,410, filed on Sep. 30, 2020.

(51) Int. Cl.
*A41D 13/11* (2006.01)
*A42B 3/20* (2006.01)

(52) U.S. Cl.
CPC ..... *A42B 3/20* (2013.01)

(58) Field of Classification Search
CPC ..... A42B 3/20; A42B 3/18; A41D 13/1161; A41D 13/11
See application file for complete search history.

(56) References Cited

U.S. PATENT DOCUMENTS

| | | | | |
|---|---|---|---|---|
| 4,817,596 | A * | 4/1989 | Gallet | A42B 3/288 128/201.24 |
| 5,713,076 | A * | 2/1998 | Davis | A42B 1/0182 2/202 |
| 2008/0283063 | A1* | 11/2008 | Wilcox | A42B 3/28 128/206.17 |
| 2017/0332710 | A1* | 11/2017 | Bot | A41D 31/102 |
| 2022/0143434 | A1* | 5/2022 | Roesser | A62B 18/084 |
| 2022/0151315 | A1* | 5/2022 | Hugenberg | A42B 1/018 |
| 2022/0203142 | A1* | 6/2022 | Connolly | A41D 13/11 |
| 2022/0400804 | A1* | 12/2022 | Hazewinkel | A42B 3/20 |

FOREIGN PATENT DOCUMENTS

| | | | |
|---|---|---|---|
| WO | WO-2021216817 | A1 * | 10/2021 |
| WO | WO-2022123095 | A1 * | 6/2022 |

* cited by examiner

*Primary Examiner* — Tajash D Patel
(74) *Attorney, Agent, or Firm* — Brooks Kushman P.C.

(57) ABSTRACT

A facemask assembly for a helmet is provided with a facemask. The facemask has an upper edge to be adjacent to a nose of a user and a lower edge to be adjacent to a chin of the user when the facemask is connected to the helmet. A first end attachment member is connected to a first end region of the facemask to attach to a faceguard. A second end attachment member is connected to a second end region of the facemask to attach to the faceguard. A series of intermediate attachment members are spaced apart from one another and connected to the facemask between the first and second end regions, with each intermediate attachment member to attach to the faceguard. A method of forming the facemask is also provided.

20 Claims, 4 Drawing Sheets

FACEMASK FOR A HELMET AND FACEGUARD

CROSS-REFERENCE TO RELATED APPLICATIONS

This application claims the benefit of U.S. provisional application Ser. No. 63/085,410 filed Sep. 30, 2020, the disclosure of which is hereby incorporated in its entirety by reference herein.

TECHNICAL FIELD

Various embodiments relate to a face mask for use in a helmet, such as a sports or athletic helmet.

BACKGROUND

Helmets may be used as a safety device, for example, for sports or athletics. The athletic body may require a helmet for participation by an athlete. These helmets may be provided with a faceguard, such as a wire frame faceguard. Alternatively, different face guards may be attachable to and used with a helmet. The helmet and faceguard are not intended to provide protection against airborne or aerosol particles or pathogens.

SUMMARY

In an embodiment, a facemask for a helmet with a faceguard is provided. The facemask has a first fabric member having a first end connector, and a second fabric member having a second end connector. The second fabric member is connected to the first fabric member via a central seam such that the first fabric member defines a first end region of the facemask and the second fabric member defines a second end region of the facemask. The first and second fabric members collectively define an upper edge of the facemask. A third fabric member is connected to the first and second fabric members via a transverse seam, with the third fabric member spaced apart from the first and second end region of the facemask. The first, second, and third fabric members collectively define a lower edge of the facemask. An upper connector extends outwardly from the facemask, is positioned between the first and second fabric members, and is connected via the central seam. The upper connector is spaced apart from the upper edge of the facemask and the transverse seam. First and second lower connectors extend outwardly from the facemask, are positioned between the first and third fabric members, and are connected via the transverse seam. Third and fourth lower connectors extend outwardly from the facemask, are positioned between the second and third fabric members, and are connected via the transverse seam.

In a further embodiment, each of the first and second end connectors is a clip fastener.

In another further embodiment, the upper connector is a hook and loop fastener.

In a further embodiment, each of the first, second, third and fourth lower connectors is a hook and loop fastener.

In another further embodiment, each of the first, second, third and fourth lower connectors is a clip fastener.

In another embodiment, a facemask assembly for a helmet is provided with a facemask extending from a first end region to a second end region opposite to the first end region. The facemask has an upper edge to be adjacent to a nose of a user and a lower edge to be adjacent to a chin of the user when the facemask is connected to the helmet. A first end attachment member is connected to the first end region of the facemask to attach to a faceguard. A second end attachment member is connected to the second end region of the facemask to attach to the faceguard. A series of intermediate attachment members are spaced apart from one another and connected to the facemask between the first and second end regions, with each intermediate attachment member to attach to the faceguard.

In a further embodiment, the facemask has a first side member, a second side member, and a lower member connected to one another. The first side member defines the first end region, and the second side member defines the second end region.

In another further embodiment, edges of the first and second side members are directly connected to one another along a first seam, the first side member extends from the first seam to the first end region, and the second side member extends from the first seam to the second end region.

In a further embodiment, the lower member is directly connected to the first and second side members along a second seam.

In another further embodiment, the lower member and the second seam extends along a lower edge of the first and second side members and is spaced apart from the first and second end regions.

In a further embodiment, the first seam is positioned between opposite ends of the second seam.

In another further embodiment, one intermediate attachment member of the series of intermediate attachments members is connected to the facemask at the first seam, and the one of the intermediate attachment members is spaced apart from the second seam.

In a further embodiment, the one intermediate attachment member is a hook and loop fastener.

In another further embodiment, at least two intermediate attachment members of the series of intermediate attachment members are connected to the facemask via the second seam.

In a further embodiment, each of the at least two intermediate attachment members are hook and loop fasteners.

In another further embodiment, each of the at least two intermediate attachment members are clip fasteners, with each clip fastener sized to receive a portion of the faceguard.

In a further embodiment, two intermediate attachment members of the series of intermediate attachment members are connected to the facemask via the second seam and are positioned between the first end region and the first seam. Another two intermediate attachment members of the series of intermediate attachment members are connected to the facemask via the second seam and are positioned between the second end region and the first seam.

In another further embodiment, the first and second side members cooperate to form the upper edge of the facemask.

In a further embodiment, the lower member forms at least a portion of the lower edge of the facemask.

In another further embodiment, each of the first and second side members has a concave upper edge.

In a further embodiment, the facemask comprises a fabric.

In another further embodiment, the facemask comprises a woven fabric and/or a knitted fabric.

In a further embodiment, the facemask comprises one of a polyester knit fabric, a cotton knit fabric, a polyester-lycra knit fabric, and a nylon woven fabric.

In another further embodiment, the first end attachment member is sized to extend through a first aperture formed by one of the helmet and the faceguard to attach to the faceguard. The second end attachment member is sized to extend through a second aperture formed by one of the helmet and the faceguard to attach to the faceguard.

In a further embodiment, the facemask is positioned inboard of a faceguard of a helmet assembly. The helmet assembly is provided with the faceguard attached to a helmet.

In another further embodiment, a chin strap connected to the helmet, the chin strap positioned inboard of the facemask.

In a further embodiment, the helmet is one of an American football helmet, a hockey helmet, a lacrosse helmet, and a baseball catcher helmet.

In an embodiment, a method of forming a facemask is provided. A first facemask member is provided and extends from a first edge to a first end region. A second facemask member is provided and extends from a second edge to a second end region. A third facemask member is provided. The first edge of the first facemask member is connected to the second edge of the second facemask member to collectively define an upper edge of the facemask. The third facemask member is connected to the first and second facemask members opposite to the upper edge. A first side connector is connected to the first end region. A second side connector is connected to the second end region. A first intermediate connector is connected to the first and second facemask members between the first and second edges. A second intermediate connector is connected to the first facemask member and the third facemask member. A third intermediate connector is connected to the second facemask member and the third facemask member.

In another embodiment, a method of attaching a facemask to a helmet is provided. A facemask is positioned on an inboard side of a faceguard connected to a helmet. A first end region of the facemask is positioned through a first side aperture formed by one of the helmet and the faceguard, and a first side connector is connected to the faceguard. A second end region of the facemask is positioned through a second side aperture formed by the one of the helmet and the faceguard, and a second side connector is connected to the faceguard. A series of intermediate connectors of the facemask are directly connected to the faceguard.

DETAILED DESCRIPTION

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
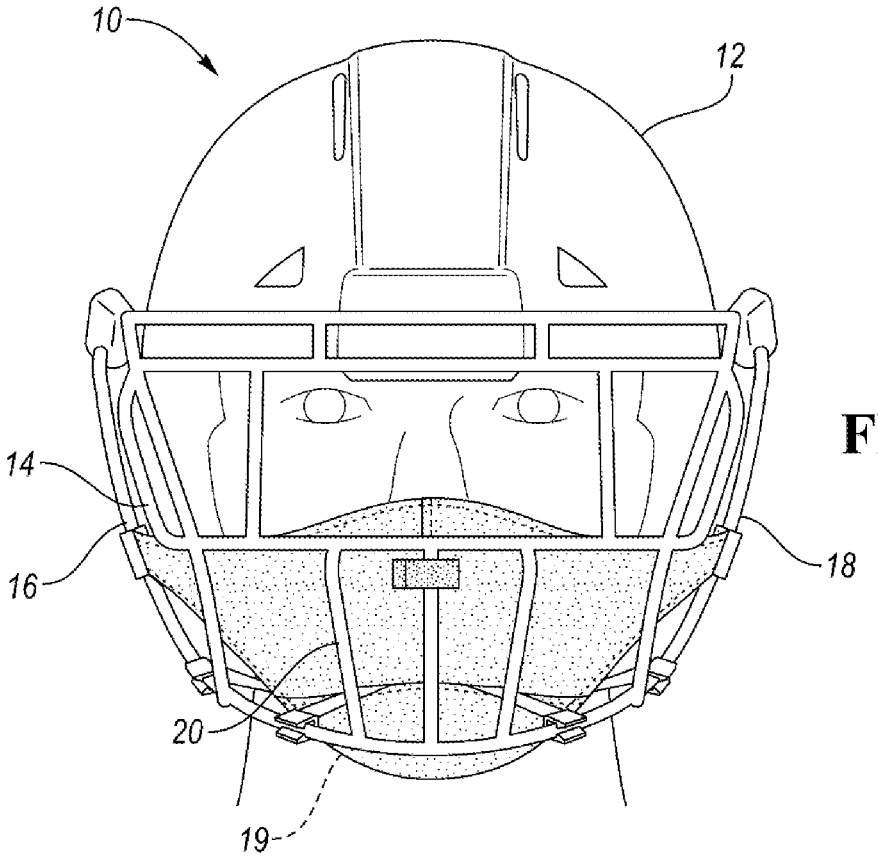
FIG. 1 is a schematic front view of a helmet assembly according to an embodiment.
Figure 2:
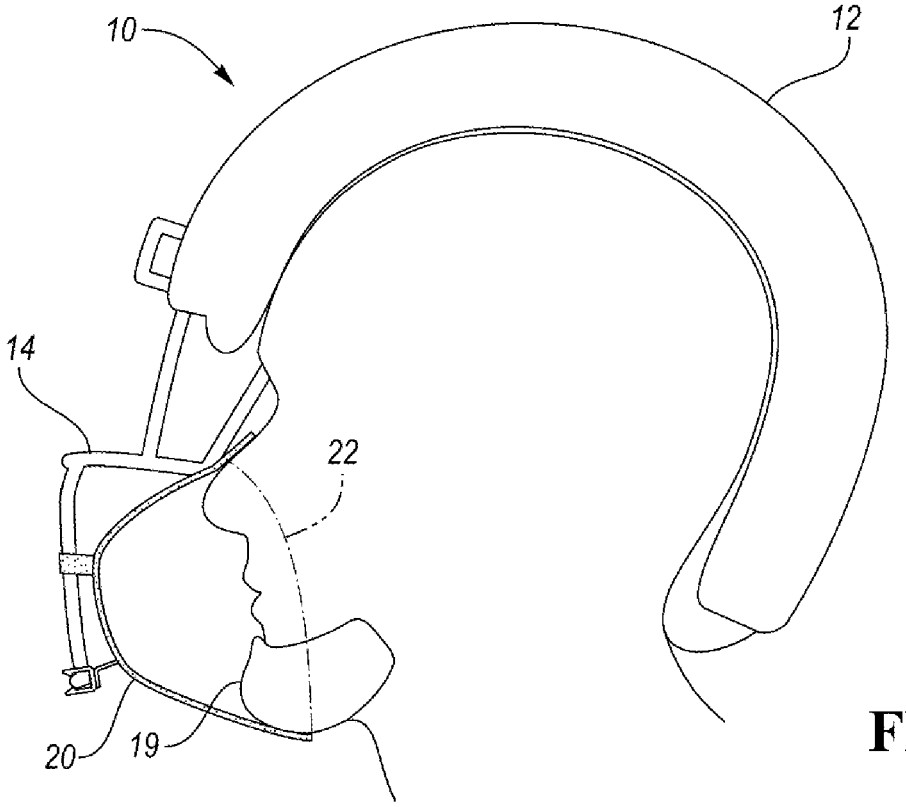
FIG. 2 is a schematic side view of the helmet assembly of FIG. 1.

FIGS. 1-2 illustrate schematic views of a helmet assembly 10 having a helmet 12, faceguard 14, and facemask 20 according to the present disclosure. The helmet 12 illustrated is an American football helmet; however, other helmets that use or incorporate a faceguard are also contemplated for use with the facemask according to the present disclosure. For example, the helmet 12 may be another type of sports or athletic helmet, or other helmet that uses a faceguard. Other non-limiting examples of helmets for use with the present disclosure include a hockey helmet, a lacrosse helmet, and a baseball catcher helmet.

The faceguard 14 may be integrally formed with the helmet 12, or may be attachable to or connected to the helmet. In some examples, different size or different configuration faceguards 14 may be used with the helmet. In one example, the faceguard 14 is a wireframe faceguard as shown.

In some examples, and as shown, the helmet 12 defines first and second side apertures 16, 18 that may be on opposed sides of the helmet, e.g. generally aligned with or adjacent to the ears of a user. In other examples, the faceguard 14 itself may define first and second side apertures 16, 18 that may be on opposed sides of the faceguard 14, e.g. generally aligned with or adjacent to the ears of a user.

In various examples, the helmet 12 may have a chin strap 19 connected to the helmet, and the chin strap 19 is used to secure the helmet 12 to the head of a user.

The facemask 20 is positioned between the face of a user and the faceguard 14. The facemask 20 is therefore on an inboard side of the faceguard 14. This protects the facemask 20 from possible abrasions or contact with another person or outside object during use.

The facemask 20 is in contact with or adjacent to the nose of the user. The facemask 20 is also adjacent to the chin and the jawline of the user. The facemask 20 is connected to the helmet 12 and/or faceguard 14, and is also shaped to form a pocket or cavity 22 such that the facemask is spaced apart from and generally not in contact with the mouth or lips of a user.

The chin strap 19 may be positioned between a chin of the user and the facemask 20 when the chin strap 19 is connected on both ends to the helmet 12.

The facemask 20 may act as a mask to prevent or reduce the transfer of particles and/or aerosols across the facemask.

Figure 3:
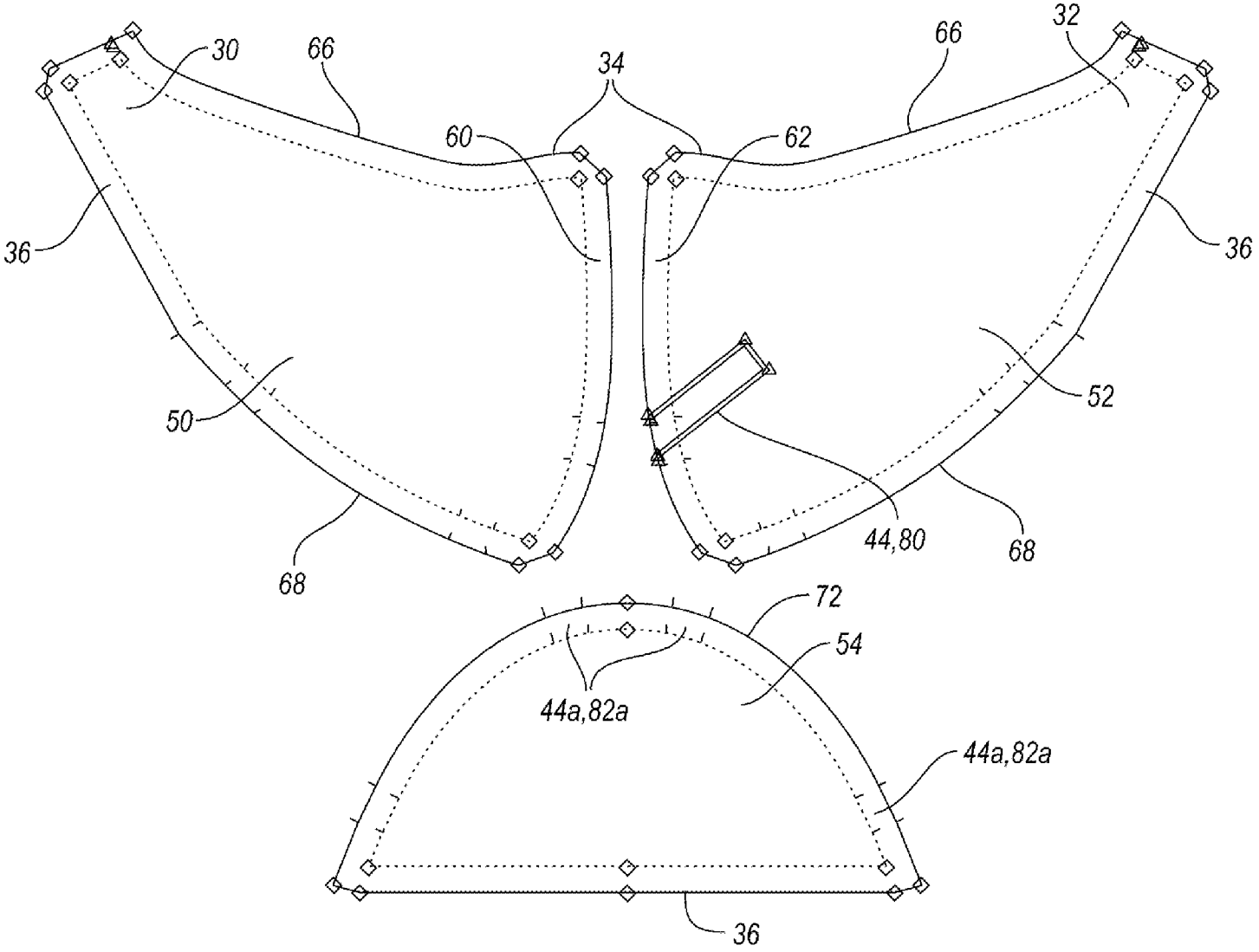
FIG. 3 is a pattern schematic view for use with a facemask according to an embodiment.
Figure 4:
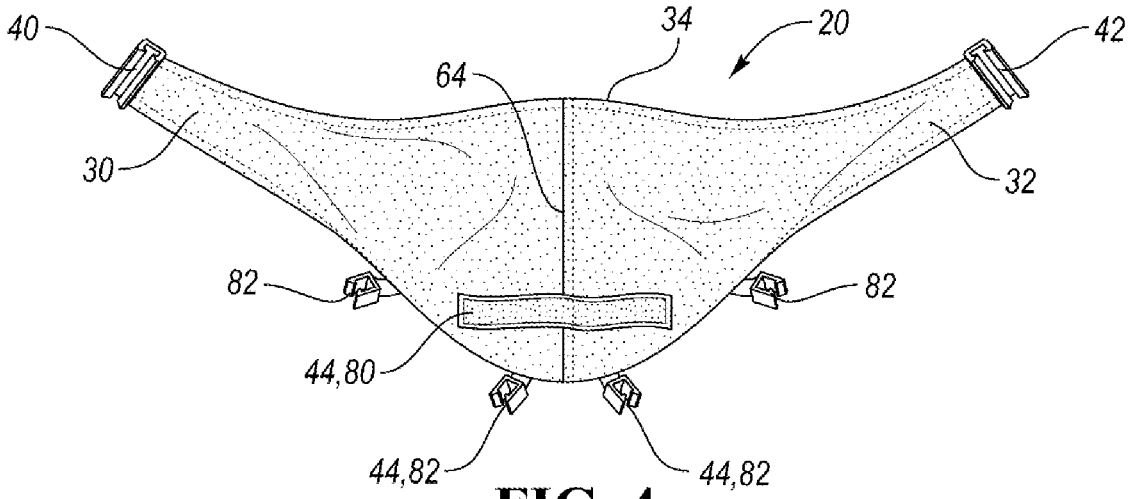
FIG. 4 is a top perspective view of a facemask according to an embodiment.
Figure 5:
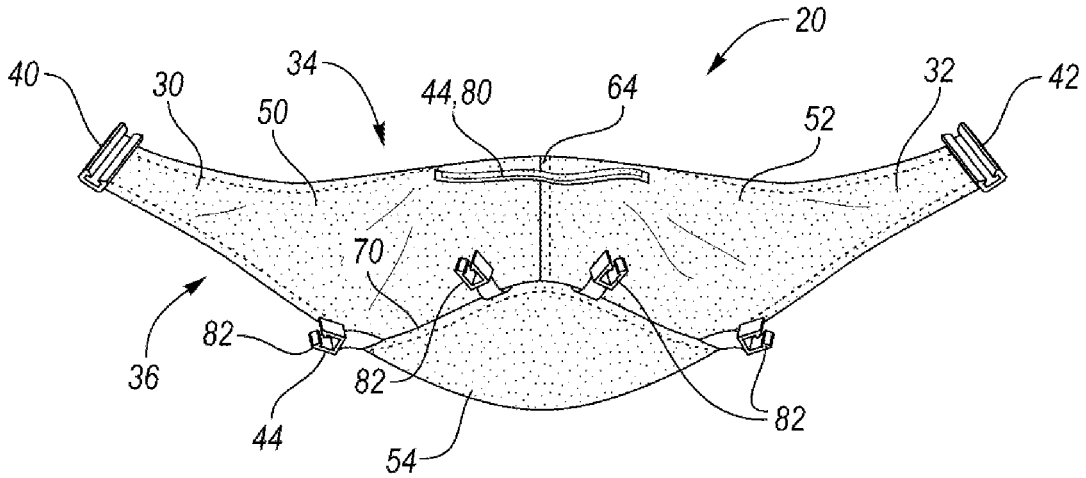
FIG. 5 is a front perspective view of the facemask of FIG. 4.

FIG. 3 illustrates a pattern for the facemask 20, and FIGS. 4-5 illustrate the facemask 20 according to an embodiment. In one embodiment, the body of the facemask 20 is formed using the pattern as shown in FIG. 3.

The facemask 20 extends from a first end region 30 to a second end region 32 opposite to the first end region. The facemask has an upper edge 34 to be adjacent to a nose of a user and a lower edge 36 to be adjacent to a chin or a jawline of the user when the facemask is connected to a helmet.

The facemask 20 has a first end attachment member 40 connected to the first end region 30 of the facemask 20 to attach the facemask to a faceguard 14. The facemask 20 also has a second end attachment member 42 connected to the second end region 32 of the facemask to attach the facemask to the faceguard 14. The first and second end regions 30, 32 extend through the first and second side apertures 16, 18, respectively, from inside the cavity 22 of the helmet 12 and then connect to the faceguard 14 via the first and second end attachment members 40 and 42, respectively. The first and second end regions 30, 32 therefore wrap around a portion of the helmet 12 and/or the faceguard 14.

The facemask 20 has a series of intermediate attachment members 44 spaced apart from one another and connected to the facemask 20 between the first and second end regions 30, 32. Each intermediate attachment member 44 is used to attach the facemask 20 to the faceguard 14.

As shown in FIG. 3, the facemask 20 may be formed from a first side member 50, a second side member 52, and a lower member 54 that are connected to one another. In one example, the facemask 20 has only three fabric members 50, 52, 54 that form the main body of the facemask. In other examples, the facemask 20 may be formed from more than three members that are connected to one another to form the body of the facemask. In yet other examples, the facemask 20 may be formed from less than three members, such as a single member.

Each of the members 50, 52, 54 may be formed from a fabric material according to various embodiments. Each member 50, 52, 54 may be formed from a woven fabric or material such as a woven fabric, an interwoven fabric, and/or a knitted fabric. The members may have elasticity in the fabric. The first, second, and/or third member of the facemask 20 may be formed or cut as a pattern from a woven fabric and/or a knitted fabric. In various examples, the first, second, and/or third member of the facemask 20 may be formed or cut as a pattern from a polyester knit fabric, a cotton knit fabric, a polyester-lycra knit fabric, a nylon woven fabric, or the like.

The first side member 50 defines the first end region 30, and extends from a first edge 60 to the first end region 30. The second side member 52 defines the second end region 32, and extends from a second edge 62 to the second end region 32. The first and second side members 50, 52 may be connected to one another via a first seam 64 or a central seam along the first and second edges 60, 62, and furthermore may be directly connected to one another. As used herein, a seam refers to a connection between two members, and preferably a connection between two fabric members. The seam may be provided via sewing, or alternatively, may be provided by an adhesive or via a fusing or welding process. If sewn to one another via a seam, stiches such as a stretch stitch for joining may be used to allow for stretching of the seam along with stretching of the fabric.

Therefore, when assembled to one another, the first side member 50 extends from the first seam 64 to the first end region 30, and the second side member 52 extends from the first seam 64 to the second end region 32.

The first and second members 50, 52 collectively define an upper edge 34 of the facemask 20 to be positioned adjacent to a nose of a user. Each of the first and second members 50, 52 may be provided by a three-sided pattern as shown. Each of the first and second members 50, 52 may be provided with a concave upper edge 66. When connected to one another, the first and second members 50, 52 form a contoured upper edge 34 for the facemask 20 that extends over the nose while providing line-of-sight or visibility for the user.

The third member 54 or lower member may be directly connected to the first and second side members 50, 52 along a second seam 70 or transverse seam. An edge 72 of the third member is sewn or otherwise connected to the lower edges 68 of the first and second members 50, 52 via the second seam 70. The third facemask member 54 is connected to the first and second facemask members 50, 52 opposite to the upper edge 34. The lower member 54 and the second seam 70 extend along a lower edge 68 of the first and second side members 50, 52 and is spaced apart from the first and second end regions 30, 32. The lower member 54 and second seam 70 are also spaced apart from the upper edge 34 of the facemask 20. The first seam 64 is positioned between opposite ends of the second seam 70.

The third member 54 may be formed from a substantially hemi-spherically shaped or arch shaped pattern as shown.

The lower member 54 forms at least a portion of the lower edge 36 of the facemask 20 to be positioned adjacent to a chin and jawline of a user. The first, second, and third fabric members 50, 52, 54 collectively define the lower edge 36 of the facemask.

In the example shown, the first seam 64 intersects upper edge 34 of facemask, and ends such that it is spaced apart from the lower edge 36 of the facemask. The second seam 70 intersects the lower edge 36 of the facemask at both ends, and is positioned between the upper edge 34 and the lower edge 36 of the facemask. The first seam 64 may meet or abut the second seam 70 in an intermediate region of the second seam 70.

The first and second end attachment members 40, 42 or end connectors are connected to the first and second end regions 30, 32 of the facemask 20, respectively. In one example, and as shown, the first and second end connectors 40, 42 are each provided by a clip, e.g. a clip fastener that is sized to receive a portion of the faceguard. In another example, the first and second end connectors 40, 42 may each be provided by a hook and loop fastener.

According to one example, the first end attachment member 40 is sized to extend through a first aperture 16 formed by one of the helmet 12 and the faceguard 14 to attach to the faceguard from an outboard side of the faceguard 14. The second end attachment member 42 is sized to extend through a second aperture 18 formed by one of the helmet 12 and the faceguard 14 to attach to the faceguard from the outboard side of the faceguard 14 and on an opposite side of the faceguard relative to the first end attachment member 40.

The facemask 20 has a series of intermediate attachment members 44 or intermediate connectors that are connected to the facemask and extend outwardly therefrom. The intermediate connectors 44 may be positioned between the first and second end regions 30, 32 of the facemask, and are spaced apart from one another. In various examples, the intermediate connectors 44 may be equally spaced from one another, or may have variable spacing.

One of the series of intermediate connectors 44, also referred to as an upper connector 80, extends outwardly from the facemask 20, is positioned between the first and second fabric members 50, 52, and is connected via the first seam 64 or the central seam. The upper connector 80 is spaced apart from the upper edge 34 of the facemask, the upper connector 80 may also be spaced apart from the second seam 70 or transverse seam. The upper connector 80 may be positioned to attach to a vertical bar on the faceguard 14 to limit transverse movement of the facemask 20. The upper connector 80 may also pull or tension the facemask 20 upwardly and away from the nose of a user.

In the example shown, the upper intermediate attachment member or upper connector 80 is a hook and loop fastener that is attached to the facemask 20 via the first seam 64. In another example, the upper intermediate attachment member or upper connector 80 is a clip with a non-woven extension that may be attached to the facemask via the first seam 64.

The clip may be a clip fastener that is sized to receive a portion of the faceguard 14, e.g. a bar portion of the faceguard.

Other members of the series of intermediate attachment members 44, or lower connectors 82, are connected to and extend outwardly from the facemask 20 via the second seam 70 or the transverse seam. FIG. 3 illustrates the attachment locations 44*a*, 82*a* for the lower connectors 82 relative to the third member 54. In the example shown in FIGS. 4-5, the lower connectors 82 are provided as clip fasteners, with each clip fastener sized to receive a portion of the faceguard 14, e.g. a bar region of the faceguard. The clip fastener of the lower connector 82 may be provided with a non-woven fabric tail that is attached to the facemask 20 via the second seam 70. In another example, the lower connectors 82 may be provided as hook and loop fasteners, or a combination of clip fasteners and hook and loop fasteners.

In the example shown, the facemask 20 has four lower connectors 82, with two of the lower connectors 82 positioned between the first end region 30 and the first seam 64, positioned between the first and third fabric members 50, 54, and connected to the facemask via the second, transverse seam 70. Another two of the lower connectors 82 are positioned between the second end region 32 and the first seam 64, positioned between the second and third fabric members 52, 54, and connected to the facemask via the second transverse seam 70.

The lower connectors 82 may be positioned to attach to a horizontal bar on the faceguard 14 to limit vertical movement of the facemask 20. The lower connectors 82 may also pull or tension the facemask 20 outwardly and downwardly and away from the face and chin of a user.

The shape of the facemask 20 as provided by the first, second, and third members 50, 52, 54, the elasticity of the material used to form the first, second, and third members 50, 52, 54, and the use of the connectors 40, 42, 44 allows for the facemask 20 to be securely fastened to the faceguard 14 while creating a pocket or cavity 22 to receive a portion of a face. In one non-limiting example, the material used to form the first, second and third members 50, 52, 54 may have a 75% to 100% stretch capability. The facemask 20 is tensioned and held in position so that it is generally spaced apart from the face in order to provide enhanced comfort and use during sporting activities or the like.

In one example, and as shown, the facemask 20 may be mirror symmetric about the first seam 64.

Although the first, second, and third members 50, 52, 54 are shown as providing a single layer for the facemask 20, it is also contemplated that one or more of the members may be formed using multiple plies or layers of fabric. When using multiple layers, the layers may be connected to one another, for example, as a quilted layer, to prevent the layers moving relative to one another.

The first, second, and third members 50, 52, 54 may be hemmed or otherwise finished along the edges to prevent fraying of the fabric. A zig zag stitch or a stretch stitch may be used to hem or finish the members 50, 52, 54 according to one non-limiting example.

In further embodiments, the facemask 20 may be provided with vents. In another embodiment, the facemask 20 may be provided with a disposable or replaceable filter insert that attaches to the facemask.

Figure 6:
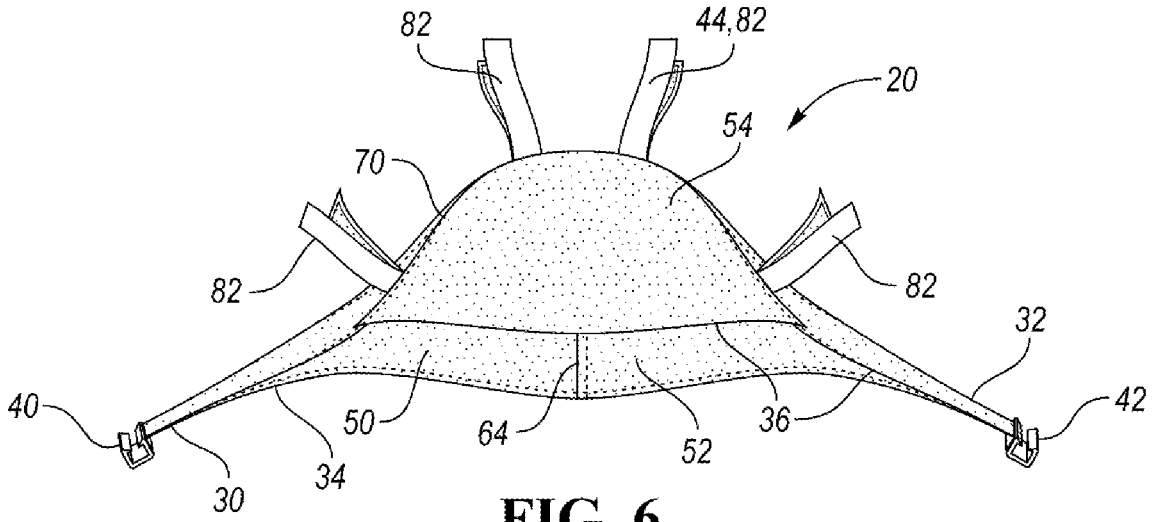
FIG. 6 is a bottom perspective view of a facemask according to another embodiment.

FIG. 6 illustrates a bottom view of the facemask 20 according to another embodiment. The pattern as shown in FIG. 3 may be used to form the facemask 20 of FIG. 6. Elements that are the same as or similar to those described above with respect to FIG. 3-5 are not described again with respect to FIG. 6, and may be given the same reference numbers as those used above for simplicity. The facemask 20 may be used with the helmet assembly 10 as described with respect to FIGS. 1-2 according to an embodiment.

The lower connectors 82 or lower intermediate members may be each provided as hook and loop fasteners, and may be sewn or connected to the facemask 20 via the second seam 70. The upper connector 80 and end connectors 40, 42 may be provided as described above with respect to FIGS. 3-5.

In other examples, the facemask 20 may be provided with other combinations or other numbers of connectors 40, 42, 44 such as clips, hook and loop, snaps, button and buttonhole, or other fasteners for use in connecting the facemask to the helmet 12 and faceguard 14.

Figure 7A:
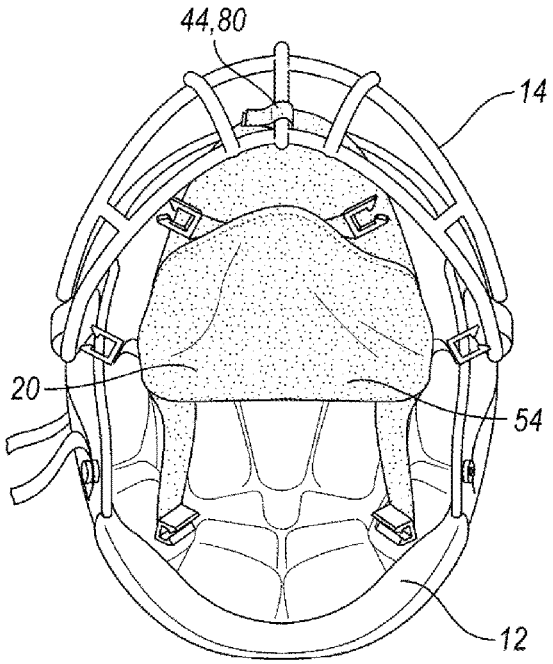
FIGS. 7A, 7B, and 7C are schematic views for a method of assembling a facemask to a helmet and faceguard according to an embodiment and to form a helmet assembly.
Figure 7B:
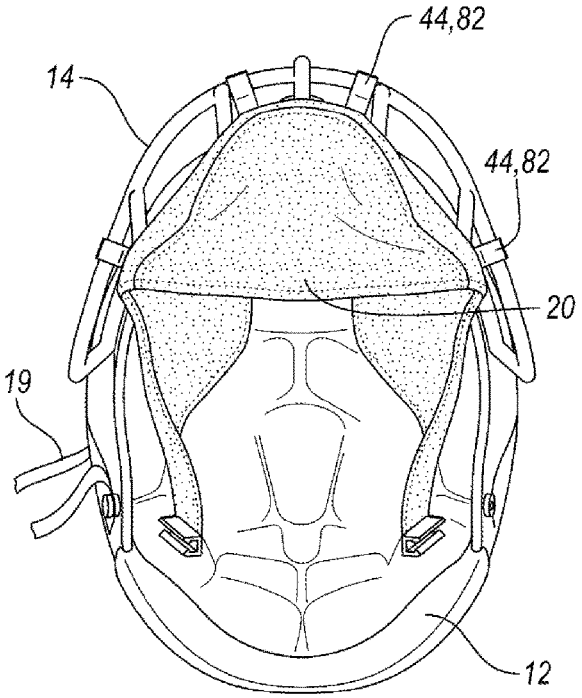
Figure 7C:
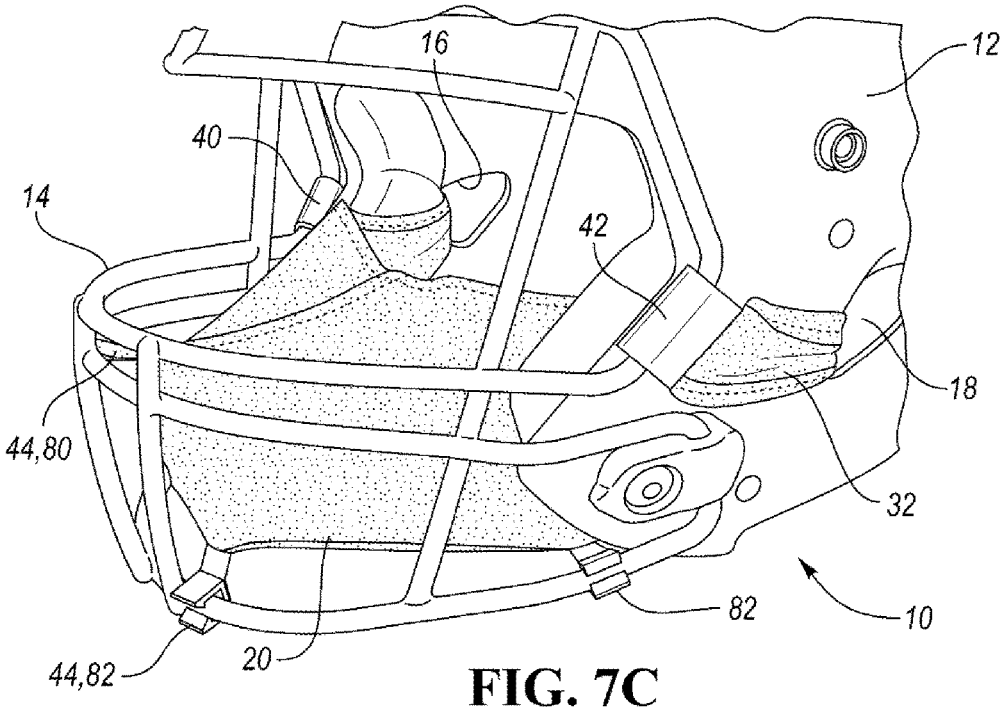

FIGS. 7A-C illustrate a schematic series of figures showing a method of attaching the facemask to a helmet and faceguard, and may be used with the facemask 20, helmet 12, and faceguard 14 as described above to provide a helmet assembly. According to various embodiments, the method may have greater or fewer steps than described below, and the steps may be performed in another order.

As shown in FIG. 7A, the facemask 20 is positioned on an inboard side of a faceguard 14 connected to a helmet 12. One of the intermediate connectors 44, such as the upper intermediate connector 80 is directly connected to the faceguard 14.

In FIG. 7B, the remainder of the series of intermediate connectors 44, e.g. the lower intermediate connectors 82, of the facemask 20 are connected directly to the faceguard 14.

As shown in FIG. 7C, each of the first and second side connectors 40, 42 are attached or connected to the faceguard 14. According to one non-limiting example, a first end region 30 of the facemask 20 is positioned through a first side aperture 16 formed by one of the helmet 12 and the faceguard 14 such that it extends outwardly from the inboard side or cavity of the helmet 12, the first end region 30 is wrapped or moved towards the outer side of the faceguard 14. The first side connector 40 is then attached or connected to the faceguard 14.

Likewise, the second side connector 42 is attached or connected to the faceguard 14. According to one non-limiting example, a second end region 32 of the facemask 20 is positioned through a second side aperture 18 formed by the one of the helmet 12 and the faceguard 14 such that it extends outwardly from the inboard side or cavity of the helmet 12, the second end region 32 is wrapped or moved towards the outer side of the faceguard 14. The second side connector 42 is then attached or connected to the faceguard 14.

FIG. 7C therefore illustrates a partial perspective view of a helmet assembly 10 with a helmet 12, faceguard 14, and facemask 20 according to the present disclosure, and with the facemask 20 connected to the helmet 12 using the method as described and shown with respect to FIG. 7.

According to one example, a method of forming a facemask, such as a facemask 20 as described above with respect to FIGS. 1-7 is provided. A first facemask member 50 is provided, and the first facemask member extends from a first edge 60 to a first end region 30. A second facemask member 52 is provided, and the second facemask member extends from a second edge 62 to a second end region 32. A third facemask member 54 is also provided.

The first edge 60 of the first facemask member 50 is connected to the second edge 62 of the second facemask member 52 such that the first and second members 50, 52 cooperate to form or collectively define an upper edge 34 of the facemask 20. The third facemask member 54 is connected to the first and second facemask members 50, 52 opposite to the upper edge 34.

A first side connector 40 is attached or connected to the first end region 30. A second side connector 42 is attached or connected to the second end region 32.

A first intermediate connector 44, 80 is attached or connected to the first and second facemask members 50, 52 between the first and second edges 60, 62. A second intermediate connector 44, 82 is attached or connected to the first facemask member 50 and the third facemask member 54. A third intermediate connector 44, 82 is attached or connected to the second facemask member 52 and the third facemask member 54.

While exemplary embodiments are described above, it is not intended that these embodiments describe all possible forms of the disclosure and/or invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A facemask for a helmet with a faceguard, the facemask comprising:

a first fabric member having a first end connector;

a second fabric member having a second end connector, the second fabric member connected to the first fabric member via a central seam such that the first fabric member defines a first end region of the facemask and the second fabric member defines a second end region of the facemask, the first and second fabric members collectively defining an upper edge of the facemask;

a third fabric member connected to the first and second fabric members via a transverse seam, the third fabric member spaced apart from the first and second end region of the facemask, the first, second, and third fabric members collectively defining a lower edge of the facemask;

an upper connector extending outwardly from the facemask, positioned between the first and second fabric members, and connected via the central seam, the upper connector spaced apart from the upper edge of the facemask and the transverse seam;

first and second lower connectors extending outwardly from the facemask, positioned between the first and third fabric members, and connected via the transverse seam; and third and fourth lower connectors extending outwardly from the facemask, positioned between the second and third fabric members, and connected via the transverse seam.

2. The facemask of claim 1 wherein each of the first and second end connectors is a clip fastener; and wherein the upper connector is a hook and loop fastener.

3. The facemask of claim 1 wherein each of the first, second, third and fourth lower connectors is a hook and loop fastener.

4. The facemask of claim 1 wherein each of the first, second, third and fourth lower connectors is a clip fastener.

5. A facemask assembly for a helmet comprising:

a facemask extending from a first end region to a second end region opposite to the first end region, the facemask having an upper edge to be adjacent to a nose of a user and a lower edge to be adjacent to a chin of the user when the facemask is connected to the helmet;

a first end attachment member connected to the first end region of the facemask to attach to a faceguard;

a second end attachment member connected to the second end region of the facemask to attach to the faceguard; and a series of intermediate attachment members spaced apart from one another and connected to the facemask between the first and second end regions, each intermediate attachment member to attach to the faceguard.

6. The facemask assembly of claim 5 wherein the facemask further comprises a first side member, a second side member, and a lower member connected to one another, wherein the first side member defines the first end region, and the second side member defines the second end region.

7. The facemask assembly of claim 6 wherein edges of the first and second side members are directly connected to one another along a first seam, wherein the first side member extends from the first seam to the first end region, and wherein the second side member extends from the first seam to the second end region.

8. The facemask assembly of claim 7 wherein the lower member is directly connected to the first and second side members along a second seam.

9. The facemask assembly of claim 8 wherein the lower member and the second seam extends along a lower edge of the first and second side members and is spaced apart from the first and second end regions.

10. The facemask assembly of claim 9 wherein the first seam is positioned between opposite ends of the second seam.

11. The facemask assembly of claim 10 wherein one intermediate attachment member of the series of intermediate attachments members is connected to the facemask at the first seam, and wherein the one of the intermediate attachment members is spaced apart from the second seam.

12. The facemask assembly of claim 11 wherein at least two intermediate attachment members of the series of intermediate attachment members are connected to the facemask via the second seam.

13. The facemask assembly of claim 11 wherein two intermediate attachment members of the series of intermediate attachment members are connected to the facemask via the second seam and are positioned between the first end region and the first seam; and wherein another two intermediate attachment members of the series of intermediate attachment members are connected to the facemask via the second seam and are positioned between the second end region and the first seam.

14. The facemask assembly of claim 6 wherein the first and second side members cooperate to form the upper edge of the facemask; and wherein the lower member forms at least a portion of the lower edge of the facemask.

15. The facemask assembly of claim 6 wherein each of the first and second side members has a concave upper edge.

16. The facemask assembly of claim 5 wherein the first end attachment member is sized to extend through a first aperture formed by one of the helmet and the faceguard to attach to the faceguard; and wherein the second end attachment member is sized to extend through a second aperture formed by one of the helmet and the faceguard to attach to the faceguard.

17. The facemask assembly of claim 5 further comprising:

a helmet; and a faceguard connected to the helmet;

wherein the facemask is positioned inboard of the faceguard.

18. The facemask assembly of claim 17 further comprising a chin strap connected to the helmet, the chin strap positioned inboard of the facemask.

19. The facemask assembly of claim 17 wherein the helmet is one of an American football helmet, a hockey helmet, a lacrosse helmet, and a baseball catcher helmet.

20. A method of forming a facemask comprising:

providing a first facemask member extending from a first edge to a first end region;

providing a second facemask member extending from a second edge to a second end region; and providing a third facemask member;

connecting the first edge of the first facemask member to the second edge of the second facemask member to collectively define an upper edge of the facemask; and connecting the third facemask member to the first and second facemask members opposite to the upper edge;

connecting a first side connector to the first end region;

connecting a second side connector to the second end region;

connecting a first intermediate connector to the first and second facemask members between the first and second edges;

connecting a second intermediate connector to the first facemask member and the third facemask member; and connecting a third intermediate connector to the second facemask member and the third facemask member.

* * * * *